US008186588B2

(12) United States Patent
Morocz

(10) Patent No.: US 8,186,588 B2
(45) Date of Patent: May 29, 2012

(54) SHARED DRIVE LAUNCHER/WEAPON INTERFACE

(75) Inventor: Laszlo Morocz, Glenn Dale, MD (US)

(73) Assignee: Lockheed Martin Corporation, Bethesda, MD (US)

( * ) Notice: Subject to any disclaimer, the term of this patent is extended or adjusted under 35 U.S.C. 154(b) by 379 days.

(21) Appl. No.: 12/579,703

(22) Filed: Oct. 15, 2009

(65) Prior Publication Data

US 2011/0089237 A1 Apr. 21, 2011

(51) Int. Cl.
*G06G 7/80* (2006.01)

(52) U.S. Cl. ..... 235/400

(58) Field of Classification Search ..... 235/400
See application file for complete search history.

(56) References Cited

U.S. PATENT DOCUMENTS

| | | | | |
|---|---|---|---|---|
| 3,942,409 | A | 3/1976 | Baldwin et al. | 89/1.814 |
| 4,928,570 | A | 5/1990 | Esterlin et al. | 89/6.5 |
| 5,034,686 | A | 7/1991 | Aspelin | 324/158 |
| 5,096,139 | A | 3/1992 | Feld et al. | 244/3.1 |
| 5,591,031 | A | 1/1997 | Monk et al. | 434/14 |
| 5,742,609 | A | 4/1998 | Kondrak et al. | 370/465 |
| 5,931,874 | A | 8/1999 | Ebert et al. | 701/1 |
| 5,983,771 | A | 11/1999 | Lehr | 89/6.5 |
| 6,152,011 | A | 11/2000 | Ivy et al. | 89/1.814 |
| 6,244,535 | B1 | 6/2001 | Felix | 244/3.16 |
| 6,415,211 | B1 | 7/2002 | Kotlow | 701/35 |
| 6,941,850 | B1 | 9/2005 | McMahon | 89/1.811 |
| 7,137,599 | B1 | 11/2006 | Sitzmann et al. | 244/137.4 |
| 2003/0033059 | A1 | 2/2003 | Ebert et al. | 701/3 |

*Primary Examiner* — Daniel Hess

(74) *Attorney, Agent, or Firm* — Renner Kenner Greive Bobak Taylor & Weber

(57) ABSTRACT

A weapon launch system includes at least a command and control system, a launcher system and at least one weapon system. The command and control system generates command signals received by the launcher system. The launcher system comprises a launcher operating system that maintains a mapping server connected to a hard drive and a network layer. The mapping server partitions the hard drive into any number of virtual drives accessible by the network layer and each virtual drive maintains operational data for a specific weapon system. The weapon system is coupled to the launcher system and comprises a weapon and a weapon operating system that maintains a mapping client which mounts a designated virtual drive and obtains operational data therefrom and transfers the operational data to the weapon.

13 Claims, 4 Drawing Sheets

SHARED DRIVE LAUNCHER/WEAPON INTERFACE

TECHNICAL FIELD

The present invention is directed to weapon launch systems. Specifically, the invention is directed to weapon launch systems for launching any one of a standardized weapon or missile where the weapon actively retrieves data from a launcher to acquire targeting, guidance, fuzing, and other related information.

BACKGROUND

Modern weapon systems rely to a great extent on powered missiles. For example, platforms carry a plurality of missiles, which may be of different types. The launchers may be land-based; airborne; marine-based, such as warships; mobile; immobile or man-carried. For convenience, common launchers may be used for these different missile types. Some missiles come from the manufacturer encased in a protective container or canister, at least a part of which becomes part of the launcher. Each missile-bearing canister fits into the common launcher, and has a standardized canister connector by which signals can be transferred between the missile within the canister and the outside world. The canister connector is coded by the manufacturer, by interconnecting or jumpering certain pins, to identify the missile within and to avoid the possibility of human error in programming the missile. The standardized canister connector is connected by a standardized umbilical cable with a launch-control sequencer. Each launch-control sequencer controls the arming and firing of those missiles which are in canisters located in missile launch locations or bays connected to that launch-control sequencer. For example, a launch-control sequencer may be connected to eight launch bays, and thus may be capable of controlling the arming and firing of up to eight missiles. After firing, the bays can be reloaded with new missile canisters.

A central launch control unit, given a command to arm and fire a particular type of missile toward a particular target, provides the commands to a launch-control sequencer associated with a particular group of missile launch locations. In some embodiments the launch control unit and the launch-control sequencer may be collocated in the launcher. As mentioned, the locations may contain different types of missiles. When a missile is to be launched by a launch-control sequencer, the sequencer selects a missile of the type to be launched from among those assigned to it, and, using instructions stored in memory, goes through the appropriate arming sequence. Following the arming sequence, the launch-control sequencer waits for a launch command, and then translates a received launch command, if any, and sends the translated launch command to the selected missile.

Although the aforementioned configuration has been found effective, skilled artisans will appreciate that weapons, such as missiles, require large amounts of data—between 20 to 60 Mbs or more—before a launch sequence can be completed. Typically, this large amount of data consists of targeting data, software updates and other essential information to allow the weapon to perform its mission. Transferring this bulk data from the weapon launcher to the weapon is one of the perennial problems that each generation of weapon launcher designers must solve. The solution is partly dictated by the weapon design. Originally, it was solved by transferring the data on serial lines and, as such, hi-speed Ethernet communications are the favored method for modern weapon systems. Even though the physical interface has improved over the years, the basic data transfer method is still the same. The launcher offers the weapon a packet of information and the weapon accepts and acknowledges the information. Newer message transfer protocols and methods include encryption and generalize the data transfers and accommodate ever-larger amounts of data, but the offer/acknowledgement model is still the basis for passing bulk data between launchers and their associated weapons.

It will further be appreciated that the launcher may be used with a number of different weapon types. As such, each new weapon has its own specific data requirements. Establishing a working protocol for each new weapon type adds time and cost to the overall weapon system. Such configurations require the use of "middleware" to transfer and move bulk data between the weapon and the launcher. As used herein, middleware refers to software which integrates the independently operating components of a software system. Although the use of high-speed Ethernet data transfer protocols help, such configurations are still found lacking. Fast and secure data transfer is especially critical in combat situations. The use of data offer/acknowledgement protocols has several disadvantages. First, it requires the launcher to have fairly intimate knowledge of the weapon's data requirements. In software engineering terms, the launcher and the weapon are closely coupled. The launcher must know what data the weapon needs and when, and it must also know how the weapon needs its data formatted. Close coupling is very detrimental to a system in that it dramatically increases the cost of system development and maintenance. Additionally, such coupling severely limits the possibilities of expanding a system by scaling it up or down and/or by adding support for new missile types. Additionally, the overhead of repeated packet offers and acknowledgments consumes a substantial percentage of a data channel's effective throughput. Finally, delivering the data piece-meal to multiple weapons simultaneously, as during a ripple-fire scenario, puts a substantial coordination burden on the launcher. The data transfers must be interleaved in a coordinated fashion so that each weapon receives its correct data in the correct order at the correct time.

As is well understood in the art, weapon launcher systems and the associated weapons are networked applications which utilize "network protocol stacks" to perform their communications. Skilled artisans will appreciate that a protocol stack is generally a prescribed hierarchy of software layers, starting from an application layer at the top (the source of the data being sent) to a data link layer at the bottom (transmitting the bits or data on a wire or wireless communication system). The stack resides in each client and server, and the layered approach lets different protocols be swapped in and out to accommodate network architectures. An exemplary protocol stack may be based on the Open Systems Interconnection reference model which utilizes media layers and host layers, wherein the media layers typically comprise a physical, data link and network layer and the host layers comprise a transport, a session, a presentation and an application layer. Skilled artisans will further appreciate that the application layer relates to the network application configuration which is closest to the end user and that the physical layer is where the media is configured in a signal or binary configuration that is transmitted between the networks. Each layer of the stack implements some sort of function and the next level up builds on these functions to provide more robust and complex functions. The higher one goes up the stack, the more complex and time consuming, albeit more capable, these functions are.

In the prior art configurations of the weapon launcher scenarios set out above, the traditional data passing uses "control applications" at the highest level which requires more networking overhead than the software utilized at layers lower in the network stack.

Based upon the foregoing, it will be appreciated then that there is a need in the art for a fast, reliable way to transfer data between a launcher and weapon system so as to improve the response time of the weapon and provide for more reliable data transfer between the two systems.

SUMMARY OF THE INVENTION

In light of the foregoing, it is a first aspect of the present invention to provide a shared drive launcher/weapon interface.

It is another aspect of the present invention to provide a weapon launch system, comprising a command and control system which generates command signals, a launcher system receiving the command signals, the launcher system comprising a launcher operating system that maintains a mapping server connected to a hard drive and a network layer, the mapping server partitioning the hard drive into any number of virtual drives exported by the network layer, each virtual drive maintaining operational data, and at least one weapon system coupled to the launcher system, the at least one weapon system comprising a weapon, and a weapon operating system that maintains a mapping client which mounts a designated one of the virtual drives and obtains operational data therefrom and transfers the operational data to the weapon.

Yet another aspect of the present invention is a method for launching at least one weapon from a launcher system, comprising providing a launcher system adapted to communicate with a plurality of weapons and a command and control system, the launcher system having a launcher hard drive, partitioning the launcher hard drive into a plurality of virtual drives, storing on each virtual drive weapon operational data for each of the plurality of weapons, exporting by the launcher system the virtual drive, mounting by at least one of the plurality of weapon's virtual drive, and reading by the at least one weapon, as needed, weapon operational data from the virtual drive.

BRIEF DESCRIPTION OF THE DRAWINGS

This and other features and advantages of the present invention will become better understood with regard to the following description, appended claims, and accompanying drawings wherein:

BEST MODE FOR CARRYING OUT THE INVENTION

Figure 1A:
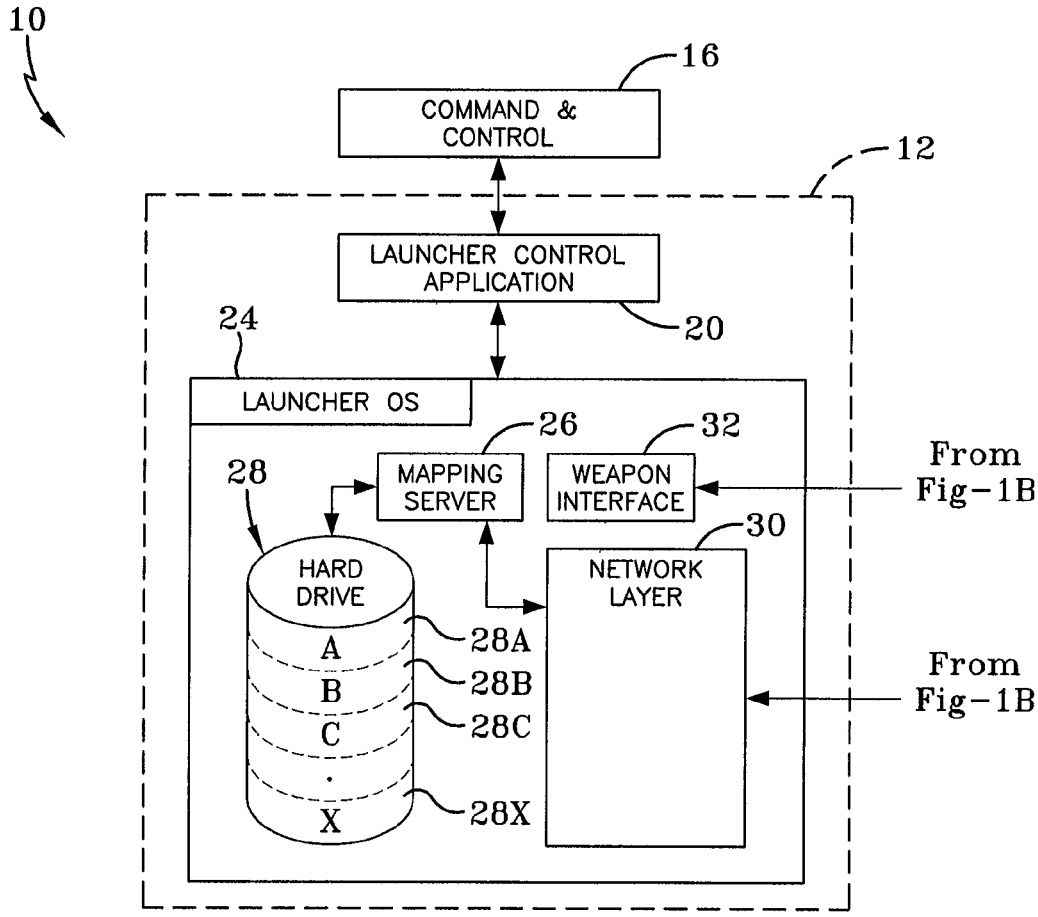
FIGS. 1A and 1B are a schematic representation of a weapon launch system showing a launcher system in communication with a weapon system according to the concepts of the present invention.
Figure 1B:
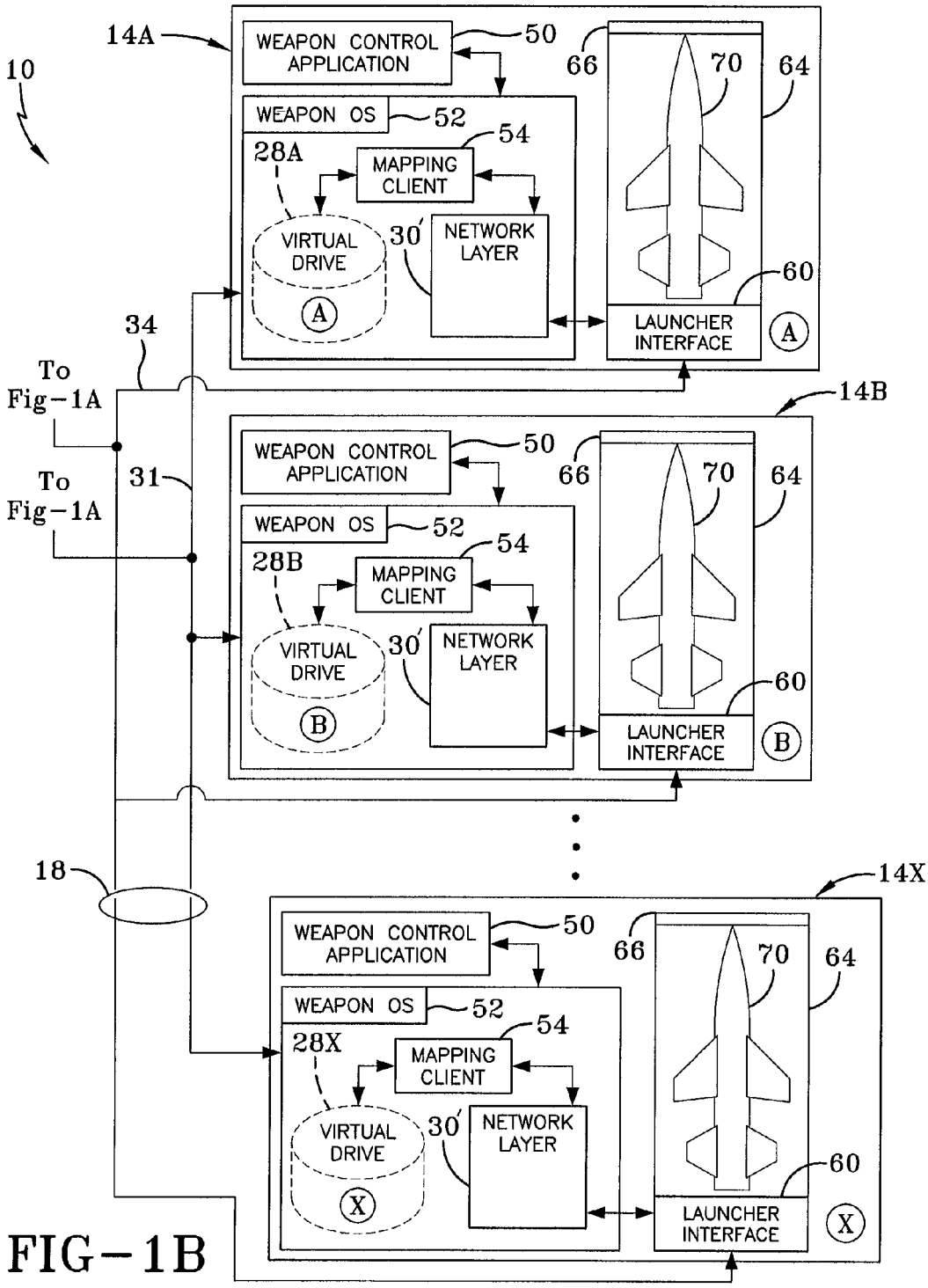

Referring now to the drawings and more particularly to FIGS. 1A and 1B, it can be seen that a weapon launch system is designated generally by the numeral 10. The system 10 includes a launcher system 12 which is associated with a weapon system 14. As shown in the drawings, more than one weapon system may be associated with a launcher system and each weapon system is provided with an alphabetic suffix. As a result, weapon systems 14A, 14B and 14X are shown in the drawing, wherein it will be appreciated that any number of suffixes could be employed.

A command and control system 16 is connected to the launcher system 12 and, as will be appreciated by skilled artisans, initiates or sends signals to the launcher system 12 for initiation of a launch sequence and launching of any number of weapons from the weapon system 14. Connections between the launcher system 12 and the weapon system 14 are typically over Ethernet cabling or other connection designated generally by the numeral 18. These can be either hardwired or wireless signal connections between the two systems. It will further be appreciated that any number of redundancies may be provided between the command and control system 16, the launcher system 12 and the weapon system 14. Each weapon system 14 is of a modular configuration inasmuch as the weapon system of 14A may be similar to or different than the weapon system 14B. In other words, the weapons associated with the respective systems may be of the same type with just slight variations, or they may be of significantly different types.

The launcher system 12 includes a launcher control application 20 which provides for direct user interface, if needed, with the command and control, and/or the technician associated with a specific launcher system. In any event, the launcher control application 20 is linked with a launcher operating system 24 which facilitates operation of the launcher system. Incorporated into the operating system is a mapping server 26 which is linked to a hard drive 28. As referred to herein, the term hard drive refers to any type of persistent mass storage device which may be accessed the same way as a hard drive. As a result, the system 10 disclosed is compatible for use with solid state hard drives and the like. In other words, the system 10 is compatible with any mass storage device that is accessed in the same way as a hard drive and which may be implemented with a plurality of technologies not limited to rotating media, including solid state devices, and which may be referred to for convenience as a "hard drive." The mapping server 26 handles exporting partitions of the hard drive 28 which are represented by suffixes, e.g. 28A, 28B, 28C, . . . 28X. In other words, the mapping server 26 partitions or segments the hard drive 28 into areas that are specifically for association with different weapon systems 14. In some embodiments it will be appreciated that a partition can be shared by multiple weapons but only as long as the particular shared partition is not modified. Also associated with and connected to the mapping server 26 is a network layer 30 which transmits operational data 31 to the weapon system 14. The weapon system 14 also includes a weapon interface 32 which allows for exchange of interface data 34 between the weapon system 14 and the launcher system 12. The interface data 34 typically comprises power and any discrete signals such as battery enable ignition, data related to operational sensors, and the like.

Figure 2:
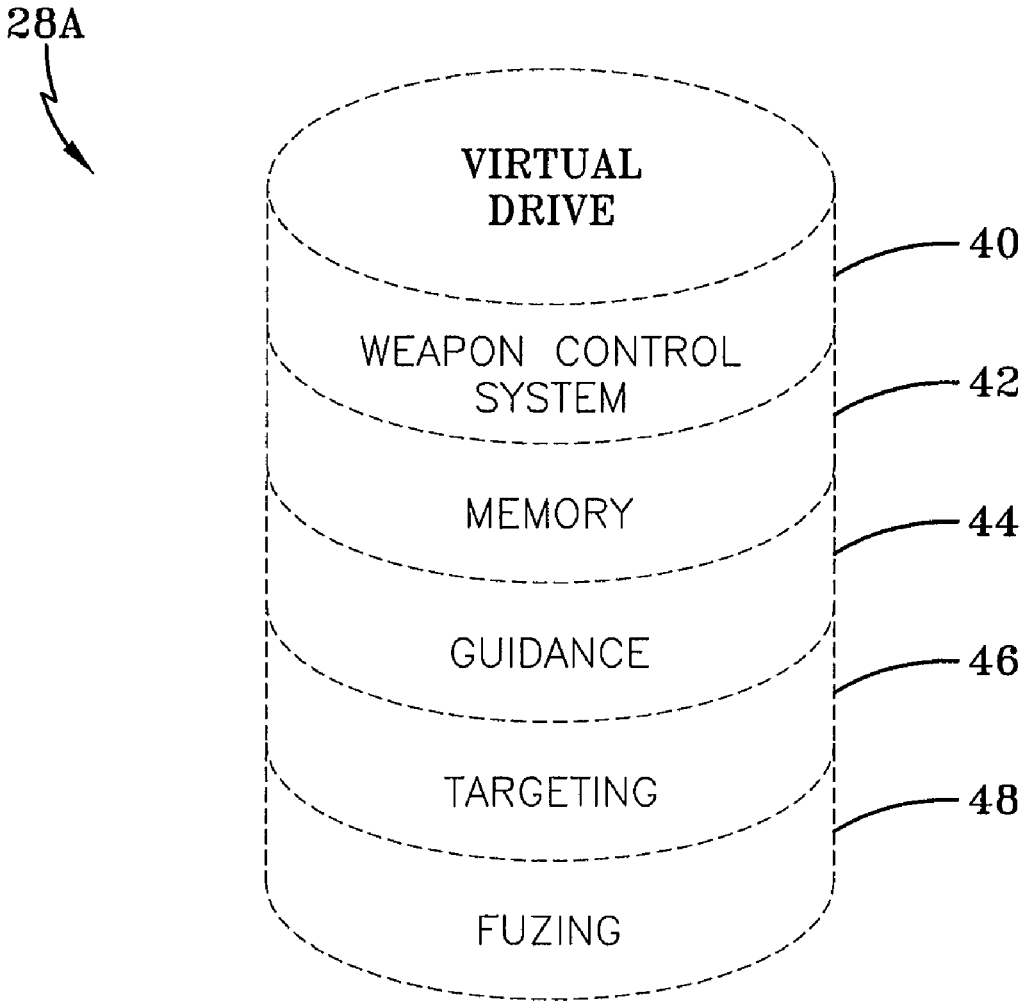
FIG. 2 is a schematic representation of a virtual hard drive utilized by the weapon system according to the present invention.

Referring now to FIG. 2, it can be seen that the hard drive 28, and specifically a partitioned hard drive or virtual drive 28A, may be further segmented, as needed, into programming associated with a particular weapon system. For example, the virtual drive 28A may be segmented into a weapon control system 40 which handles housekeeping functions and maintains and ensures operation of power supplies, sensors and all the internal components and generates appropriate messages as needed for operation of the weapon system. In some embodiments, the segmentation may be in the form of data folders and data files, i.e., directories and files, depending upon the particular operating system used. And in other embodiments, where classified data is being used, the partition may contain a single undifferentiated, and possibly encrypted, file. The weapon accessing such a file would unpack and extract the correct segments. In such a scenario the launcher is oblivious to the treatment of the segment. A portion of the virtual drive may be designated for memory 42 so as to facilitate operation of the weapon system. Skilled artisans will appreciate that if the memory 42 is modified by a particular weapon system 14, then that particular partition cannot be shared with any other weapon system. A further portion of the virtual drive is associated with guidance 44 which includes Global Positioning System functions or similar information and internal maps so that the weapon or missile travels to the intended target. Another portion of the virtual drive is segmented into targeting 46 which provides close range functions so as to determine specific targets such as tanks, personnel, bridges and/or buildings, for acquisition by the weapon and for determining which target should be selected. Another portion of the virtual drive is designated for fuzing 48 which relates to when the weapon is to be detonated, such as associated with a particular target. For example, certain fuzing programs may be implemented to maximize destruction of a bridge in contrast to another set of instructions which may be utilized to destroy a tank. It will further be appreciated that other areas of the virtual drive may be segmented or partitioned as dependent upon the weapon system associated therewith.

Referring back to FIGS. 1A and 1B, it can be seen that the weapon system 14A includes a weapon control application 50 which allows for direct access to the particular weapon system and/or hardware associated therewith. Included in the weapon system 14A is a weapon operating system 52 which maintains a mapping client 54. Both the operating system and the mapping client 54 work together so as to make the virtual drive 28A appear as it would be specifically associated with the weapon system 14A. In other words, although the drive 28A is schematically shown within the weapon system 14A, the drive 28A is physically part of the launcher system 12.

The weapon system 14 also includes a network layer 30' that is associated with the mapping client 54 and maintained by the weapon operating system 52. The network layer 30 maintained by the launcher system 12 and the network layer 30' maintained by the weapon system 14 communicate with one another via the operational data 31. In operation, the weapon control application 50 attempts to read or write data from the virtual drive 28. The weapon operating system 52 recognizes that a virtual drive access is being attempted and the mapping client 54 is instructed by the operating system 52 to perform the requested transaction with the virtual drive by re-formulating the read/write request to a service request. This request is given to the network layer 30' which sends the request to the network layer 30 maintained by the launcher system 12, which in turn requests that the mapping server 26 fulfill the request by reading or writing form/to the physical hard drive 28. Any data that needs to be returned to the mapping client 54 goes via the reverse path.

The weapon system 14A also includes a launcher interface 60 which is connected to the weapon interface 32 as previously discussed. The launcher interface 60 also receives operational data from the network layer 30' so that all of the information maintained on the virtual drive is accessible and provided to a weapon 70. In the embodiment shown, a weapon 70 may be maintained within a canister 64 that is sealed by a membrane 66. However, in some embodiments a canister with a membrane is not required. For example, some air-to-ground weapons provide a direct interface with the launcher. The interface connects the launcher to the weapon system and it will be appreciated that any type of weapon, such as an air-to-air or surface-to-air, or other type of missile, or any projectile that employs software for operation thereof, may be employed.

Figure 3:
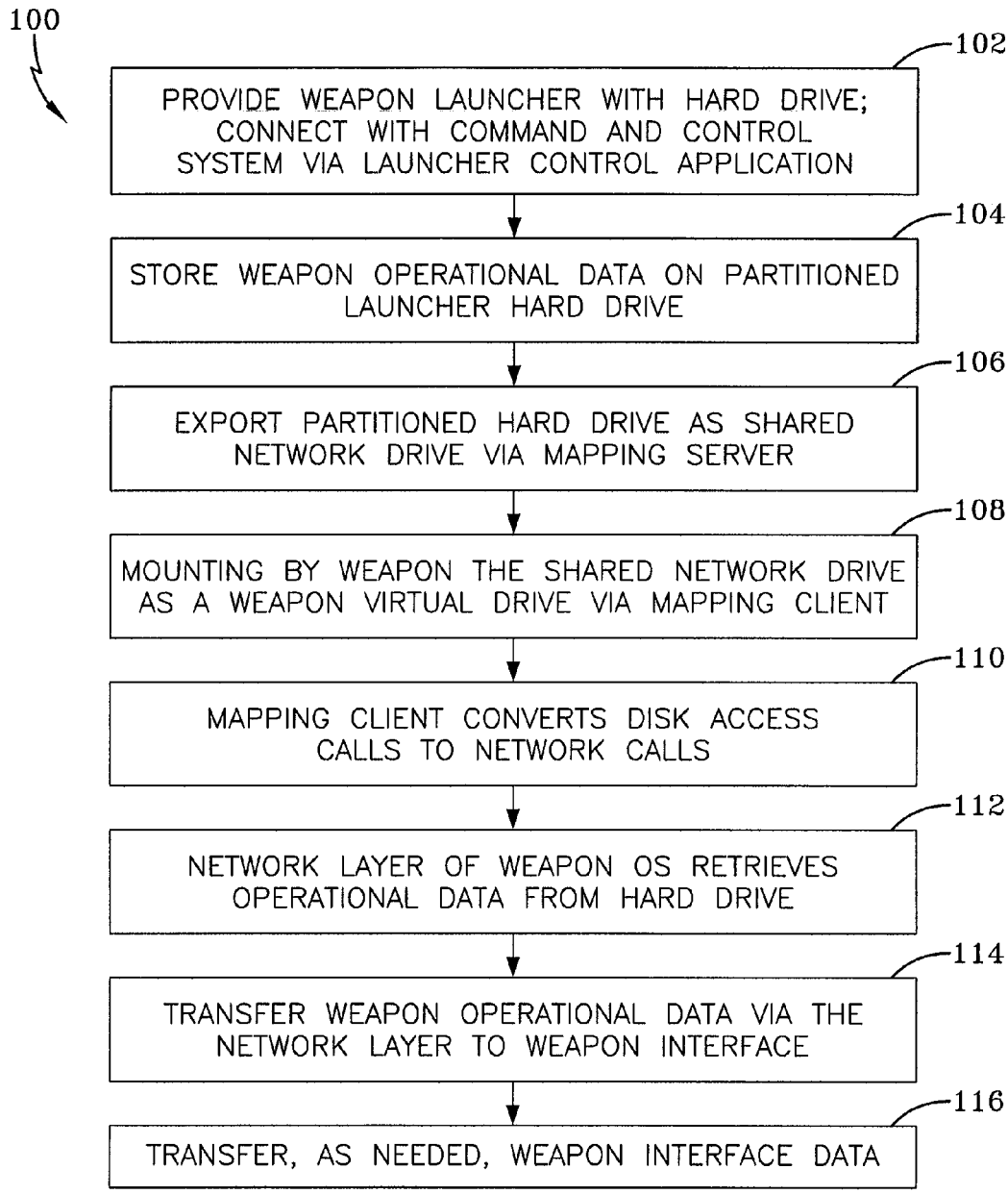
FIG. 3 is a flow chart showing a methodology of operation for the weapon launch system according to the present invention.

Referring now to FIG. 3, an operational flow chart utilizing the aforementioned components is designated generally by the numeral 100. At step 102 of the methodology, the weapon launcher 14 is provided with a hard drive 28 and the launcher is connected to the command and control system 16 by a launcher control application 20. Next, at step 104, operational data for any weapon to be associated with the launcher is stored on the partitioned launcher hard drive 28. This is typically done when the weapon system 14 is first associated with the launcher system 12. Next, at step 106, the partitioned hard drive is exported as a shared network or virtual drive 28A via the mapping server 26 to the respective weapon system 14. At step 108 the weapon system mounts the shared network drive as a weapon virtual drive via the mapping client 54 of the weapon operating system 52. During operation of the weapon system, at step 110, the mapping client 54 converts disk access calls to network calls and next, at step 112, the network layer 30' in the weapon system 14A retrieves operational data from the virtual drive 28A.

At step 114 the weapon operational system 52 transfers operational data 31 from the network layer to the launcher interface 60 with the data as needed. And simultaneously with step 114, the weapon interface data 32 is transferred to the launcher interface 60 as needed. It will be appreciated; however, that weapon interface data may be transferred at any time during connection of the weapon system with the launcher system.

The advantages of the foregoing configuration are many. In the present configuration disclosed, the weapon is no longer a passive recipient accepting and acknowledging data whenever the launcher system 12 decides to send the data to the weapon. Instead, the weapon system 14 actively retrieves the data whenever it is required. As such, the launcher is relieved of the necessity of managing data transfers. In other words, the launcher system 12 and the weapon system 14A pass bulk data via the shared drive or the virtual drive 28A. This allows the launcher to utilize off-the-shelf software to make certain portions of its bulk storage media available to the weapon. As a result, when the weapon needs the data in a particular data file, it simply reads the file from the virtual drive. By utilizing such a configuration, the slow process utilized in the offer/acknowledgment model is not required. As a result, the launcher does not have to have an intimate knowledge of the weapon's data requirements and avoids the disadvantages of having the launcher knowing what exactly the weapon needs and when and how that particular data needs to be formatted. This eliminates the need for repeated packet offers and acknowledgments and, as a result, saves a significant amount of time to initiate a launch sequence for the weapon and also provides a substantial improvement of the data channels effective throughput. Such a configuration also eliminates requiring the launcher system to coordinate between various weapon systems in a situation where rapid fire or a ripple fire scenario is desired.

This configuration is also advantageous since the launcher simply makes the data available as files without interpretational manipulation and it no longer needs to know anything about what the weapon does with the data other than the fact that the files must be made available before the weapon system is powered on or actively assigned a specific target. As a result, the launcher is de-coupled from the weapon and this allows for integration of new weapon types or missiles at much lower cost than the prior art methodologies.

Still another advantage of the present invention is that the high level launcher control application no longer has to perform the offer/acknowledgment protocol. In view of the protocol stacks and utilization of the mapping server with the network layer in the launcher and the mapping client in the weapon system, enhanced throughput of the data channel, or the operational data, over the connection 18 is provided. As a result, the data integrity is handled by low-level networking software instead of high-level application software.

Each weapon's data is exported before the missile is powered on. Once the weapon is booted up, it behaves exactly as if it had its own private hard drive complete with all its operational data. The launcher control application 20 preloads the virtual media using simple generic file input/output instructions. The weapon system them reads this data also using simple generic file input/output instructions. As a result, the interface between the launcher system and the weapon system is no longer weapon-specific except for the actual data files, but since these are handled exactly the same way for all missile types, the launcher system is essentially generic for whatever missile or weapon is associated therewith. Such a configuration eliminates the bottleneck in data transfer that is associated with the close-coupling configuration of prior art launch systems.

It will further be appreciated that eliminating the offer/acknowledgment protocol considerably simplifies the weapon's software. Rather than waiting for the launcher system to provide its data, the weapon system can read the data file at its convenience. Since the reading is entirely under the control of the weapon system 14, the data transfers can be arranged to accommodate the weapons launch sequence needs by the weapon. As a result, the software development and launcher integration effort is substantially reduced. Indeed, depending on the exact weapon requirements, a shared drive interface, or virtual drive, could conceivably completely replace all data transfers between a launcher and a weapon, leaving only the discrete analog connections such as provided by the weapon/launcher interface 32, 60 as missile or weapon-specific connections.

Still yet another advantage of the present configuration is that a shared or virtual drive model also eliminates all of the complex and expensive middleware that is used in an attempt to make up for the offer/acknowledgment model's shortcomings. It will further be appreciated that use of a virtual drive can be retrofitted onto any existing launcher/weapon combination with an Ethernet data connection that can run and support shared drives. And it will be appreciated that information assurance for classified data can easily be added through the use of a virtual private network to connect the launcher to the weapon. Additional security may also be obtained through the fact that the launcher application only has to export data, not actually read or interpret the data. This configuration could also be beneficial in that any test equipment used to develop and test the launcher and the weapon may utilize the network layer interface.

Thus, it can be seen that the objects of the invention have been satisfied by the structure and its method for use presented above. While in accordance with the Patent Statutes, only the best mode and preferred embodiment has been presented and described in detail, it is to be understood that the invention is not limited thereto or thereby. Accordingly, for an appreciation of the true scope and breadth of the invention, reference should be made to the following claims.

What is claimed is:

1. A weapon launch system, comprising:

a command and control system which generates command signals;

a launcher system receiving said command signals, said launcher system comprising a launcher operating system that maintains a mapping server connected to a hard drive and a network layer, said mapping server partitioning said hard drive into any number of virtual drives exported by said network layer, each said virtual drive maintaining operational data; and at least one weapon system coupled to said launcher system, said at least one weapon system comprising a weapon, and a weapon operating system that maintains a mapping client which mounts and then maps a designated one of said virtual drives so as to obtain operational data therefrom and transfers said operational data to said weapon.

2. The weapon launch system according to claim 1, wherein said launcher operating system further comprises a weapon interface that generates interface data and said at least one weapon system further comprises a launcher interface associated with said weapon, said launcher interface receiving said operational data from said shared drive through said network layer, and interface data from said weapon interface.

3. The weapon launch system according to claim 2, wherein said weapon is maintained in a canister covered by a membrane, and wherein said canister carries said launcher interface.

4. The weapon launch system according to claim 2, wherein said mapping client converts disk access calls into network calls so as to access said designated one of said virtual drives.

5. The weapon launch system according to claim 2, wherein said launcher system further comprises a launcher control application linked to said launcher operating system, said command and control system capable of generating a ripple fire command received by said launcher operating system, said launcher operating system coordinating generation and transfer of operational data from said virtual drives to said respective weapon systems.

6. The weapon launch system according to claim 2, wherein said launcher system further comprises a launcher control application which pre-loads said operational data onto said virtual drives.

7. The weapon launch system according to claim 1, wherein each said virtual drive maintains a weapon control system.

8. The weapon launch system according to claim 7, wherein each said virtual drive maintains at least one of a targeting module, a guidance module and a fuzing module, any one of which is accessed by said weapon control system.

9. The weapon launch system according to claim 1, wherein said launcher system and said weapon system are linked via an Ethernet connection.

10. A method for launching at least one weapon from a launcher system, comprising:

providing a launcher system adapted to communicate with a plurality of weapons and a command and control system, said launcher system having a launcher hard drive;

partitioning said launcher hard drive into a plurality of virtual drives;

providing said launcher system with a mapping server to partition said launcher hard drive;

storing on each said virtual drive weapon operational data for each of said plurality of weapons;

providing each said weapon with a mapping client;

exporting by said launcher system said virtual drive;

mounting by at least one of said plurality of weapon's said virtual drive;

communicating operational data between said mapping server and said mapping client; and reading by said at least one weapon, as needed, weapon operational data from said virtual drive.

11. The method according to claim 10, further comprising: associating a launcher network layer with said mapping server; and associating a weapon network layer with said mapping client.

12. The method according to claim 11, further comprising: transferring operational data between said network layers.

13. The method according to claim 10, further comprising: providing each said weapon with a launcher interface which receives weapon interface data from said launcher as needed.

* * * * *